US009815305B2

(12) United States Patent
Mizutani et al.

(10) Patent No.: US 9,815,305 B2
(45) Date of Patent: Nov. 14, 2017

(54) PRINTING APPARATUS

(71) Applicant: BROTHER KOGYO KABUSHIKI KAISHA, Nagoya, Aichi (JP)

(72) Inventors: Shunsuke Mizutani, Aichi (JP); Tetsuya Ouchi, Aichi (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 0 days.

(21) Appl. No.: 15/086,761

(22) Filed: Mar. 31, 2016

(65) Prior Publication Data

US 2016/0288546 A1 Oct. 6, 2016

(30) Foreign Application Priority Data

Mar. 31, 2015 (JP) ..... 2015-074667
Mar. 31, 2015 (JP) ..... 2015-074668

(51) Int. Cl.

| | |
|---|---|
| ***B41J 29/38*** | (2006.01) |
| ***B41J 29/393*** | (2006.01) |
| ***B41J 2/01*** | (2006.01) |
| ***B41J 13/00*** | (2006.01) |
| ***B41J 3/60*** | (2006.01) |
| ***B65H 85/00*** | (2006.01) |

(Continued)

(52) U.S. Cl.

CPC ..... *B41J 13/0045* (2013.01); *B41J 3/60* (2013.01); *B65H 5/062* (2013.01); *B65H 5/38* (2013.01); *B65H 85/00* (2013.01); *B65H 2301/314* (2013.01); *B65H 2402/46* (2013.01); *B65H 2404/6111* (2013.01); *B65H 2405/3322* (2013.01)

(58) Field of Classification Search

CPC ..... B41J 3/60; B41J 13/0045; B41J 13/103; B41J 29/38; B41J 13/0009; B41J 13/009; B41J 11/0045; B41J 29/393; B41J 13/10

USPC ..... 347/16, 19, 101, 104

See application file for complete search history.

(56) References Cited

U.S. PATENT DOCUMENTS

| | | | |
|---|---|---|---|
| 2002/0024574 | A1 | 2/2002 | Uchida |
| 2005/0275672 | A1 | 12/2005 | Koshikawa |
| 2008/0298821 | A1 | 12/2008 | Mori |

(Continued)

FOREIGN PATENT DOCUMENTS

| | | | |
|---|---|---|---|
| JP | HEI 2-303842 | A | 12/1990 |
| JP | HEI 9-94944 | A | 4/1997 |

(Continued)

*Primary Examiner* — Jannelle M Lebron

(74) *Attorney, Agent, or Firm* — Scully, Scott, Murphy & Presser, P.C.

(57) ABSTRACT

A printing apparatus, including a sheet conveyer unit with a first roller unit, a printer unit, and a controller, is provided. The controller executes a first-face printing process, wherein an image is printed on a first face of a sheet; a switchback process, wherein the sheet after the first-face printing process is conveyed in a reverse direction by the first roller unit; a second-face printing process, wherein the image is printed on a second face of the sheet; a first ink amount determining process to determine whether an ink amount discharged in the first-face printing process at an end area of the sheet is one of greater than and equal to a first threshold amount; and a switchback setting process, wherein, if the ink amount is smaller than the first threshold amount, a rotation speed of the first roller unit is set at a higher rotation speed.

6 Claims, 9 Drawing Sheets

(51) Int. Cl.
*B65H 5/06* (2006.01)
*B65H 5/38* (2006.01)

(56) References Cited

U.S. PATENT DOCUMENTS

| | | | | |
|---|---|---|---|---|
| 2009/0085948 | A1 | 4/2009 | Kawamata et al. | |
| 2011/0158725 | A1* | 6/2011 | Asada | B41J 13/0045 399/397 |
| 2014/0035985 | A1* | 2/2014 | Arakane | B41J 13/0009 347/16 |

FOREIGN PATENT DOCUMENTS

| | | | |
|---|---|---|---|
| JP | 2003-48311 | A | 2/2003 |
| JP | 2004-224057 | A | 8/2004 |
| JP | 2004-314506 | A | 11/2004 |
| JP | 2005-349710 | A | 12/2005 |
| JP | 2008-296444 | A | 12/2008 |
| JP | 2009-83225 | A | 4/2009 |
| JP | 2013-208721 | A | 10/2013 |

* cited by examiner

PRINTING APPARATUS

CROSS REFERENCE TO RELATED APPLICATION

This application claims priority from Japanese Patent Applications No. 2015-074667 and No. 2015-074668, both filed on Mar. 31, 2015, the entire subject matters of which are incorporated herein by reference.

BACKGROUND

Technical Field

An aspect of the present disclosure relates to a printing apparatus.

Related Art

Conventionally, a printing apparatus capable of printing images on both sides of a sheet is known. For example, an inkjet printing apparatus may discharge ink at a first side of a sheet to print an image on the first side, invert the sheet to switch sides, and discharge ink at an inverted second side of the sheet to print another image. This printing method to print both sides of the sheet may be called as double-face recording or double-face printing.

For another example, an inkjet recording apparatus, which may adjust a standby period between image recording on a first face and image recording on a second face of a recording medium according to an amount of ink used to record the image on an edge of the first face, is known. In this inkjet recording apparatus, the standby period between the first face and the second face may be shortened if the ink is applied to a certain area (e.g., a central area) of the first face, which may be unlikely to be involved with troubles such as sheet jam and undesirable contact with a recording head, compared to the standby period for the recording medium when the ink is applied to an area on an edge.

SUMMARY

In the meantime, it was noted that a time period required for double-face printing in an inkjet recording apparatus might be shortened more efficiently.

The present disclosure is advantageous in that a printing apparatus, in which double-face printing may be performed in shorter time, is provided.

According to an aspect of the present disclosure, a printing apparatus, including a sheet conveyer unit configured to convey a sheet; a printer unit configured to discharge ink and print an image on the sheet being conveyed in a conveying direction by the sheet conveyer unit; and a controller configured to control the printer unit and the sheet conveyer unit according to a print job, is provided. The sheet conveyer unit includes a first roller unit disposed at a downstream position from the printer unit with regard to the conveying direction. A first conveyer path, in which the sheet conveyed by the first roller unit in the conveying direction with the image printed thereon by the printer unit travels, and a second conveyer path, in which the sheet conveyed by the first conveyer roller unit in a reverse direction travels to be inverted and is guided to return to the first conveyer path, are formed in the sheet conveyer unit. The controller is configured to execute a first-face printing process, in which the image is printed by the printer unit according to the print job on a first face of the sheet being conveyed in the first conveyer path in the conveying direction; a switchback process, in which sheet after the first-face printing process is conveyed in the reverse direction by the first roller unit through the second conveyer path to be returned to the first conveyer path; a second-face printing process, in which the image is printed by the printer unit according to the print job on a second face of the sheet returned to and conveyed in the first conveyer path along the conveying direction; a first ink amount determining process, in which whether a discharged ink amount being an amount of ink having been discharged in the first-face printing process at an end area including a leading end of the sheet with regard to the reverse direction is one of greater than and equal to a first threshold amount is determined; and a switchback setting process, in which, if the discharged ink amount at the end area is determined to be smaller than the first threshold amount, a rotation speed of the first roller unit for the switchback process is set at a higher rotation speed than a rotation speed of the first roller unit when the discharged ink amount at the end area is determined to be one of greater than and equal to the first threshold amount.

According to another aspect of the present disclosure, a printing apparatus, including a sheet conveyer unit configured to convey a sheet; a printer unit configured to discharge ink and print an image on the sheet being conveyed in a conveying direction by the sheet conveyer unit; and a controller configured to control the printer unit and the sheet conveyer unit according to a print job, is provided. The sheet conveyer unit includes a first roller unit disposed at an upstream position from the printer unit with regard to the conveying direction and a second roller unit disposed at a downstream position from the printer unit with regard to the conveying direction. A first conveyer path, in which the sheet conveyed by at least one of the first roller unit and the second roller unit in the conveying direction with the image printed thereon by the printer unit travels, and a second conveyer path, in which the sheet conveyed by the second conveyer roller in a reverse direction travels to be inverted and is guided to return to the first conveyer path, are formed in the sheet conveyer unit. The controller is configured to execute a first-face printing process, in which the image is printed by the printer unit according to the print job on a first face of the sheet being conveyed in the first conveyer path in the conveying direction; a switchback process, in which sheet after the first-face printing process is conveyed by the second roller unit through the second conveyer path to be returned to the first conveyer path; a second-face printing process, in which the image is printed by the printer unit according to the print job on a second face of the sheet returned to the first conveyer path; an ink amount determining process, in which whether a discharged ink amount being an amount of ink having been discharged at a contact area on the first face of the sheet in the first-face printing process is one of greater than and equal to a threshold amount A is determined, the contact area being an area in the sheet to contact the first roller unit during the second-face printing process; and a second-face print setting process, in which, if the discharged ink amount at the contact area is determined to be smaller than the threshold amount A, the controller sets a rotation speed of the first roller unit for conveying the sheet in the second-face printing process at a higher rotation speed higher than a rotation speed of the first roller unit for conveying the sheet in at least a part of the second-face printing process when the discharged ink amount at the contact area is determined to be one of greater than and equal to the threshold amount.

BRIEF DESCRIPTION OF THE ACCOMPANYING DRAWINGS

DETAILED DESCRIPTION

Hereinafter, a printing apparatus 1 according to embodiments of the present disclosure will be described with reference to the accompanying drawings. It is noted that various connections are set forth between elements in the following description. These connections in general, and unless specified otherwise, may be direct or indirect, and this specification is not intended to be limiting in this respect. Aspects of the present disclosure may be implemented on circuits, such as application specific integrated circuits (ASICs), or in computer software as programs storable on computer-readable media including, but not limited to, RAMs, ROMs, flash memories, EEPROMs, CD-media, DVD-media, temporary storage, hard disk drives, floppy drives, permanent storage, and the like.

In the following description, identical parts or items may be referred to by a same reference sign, and repetitive explanation of those may be omitted. While the accompanying drawings may illustrate aspects of a configuration of the printing apparatus 1 including elements that are necessary in the present disclosure, some of parts and items that may not be related to the description of the present invention may be omitted. Further, the present embodiment may not necessarily be limited to the embodiment described below.

First Embodiment

[Overall Configuration of the Printing Apparatus]

Figure 1:
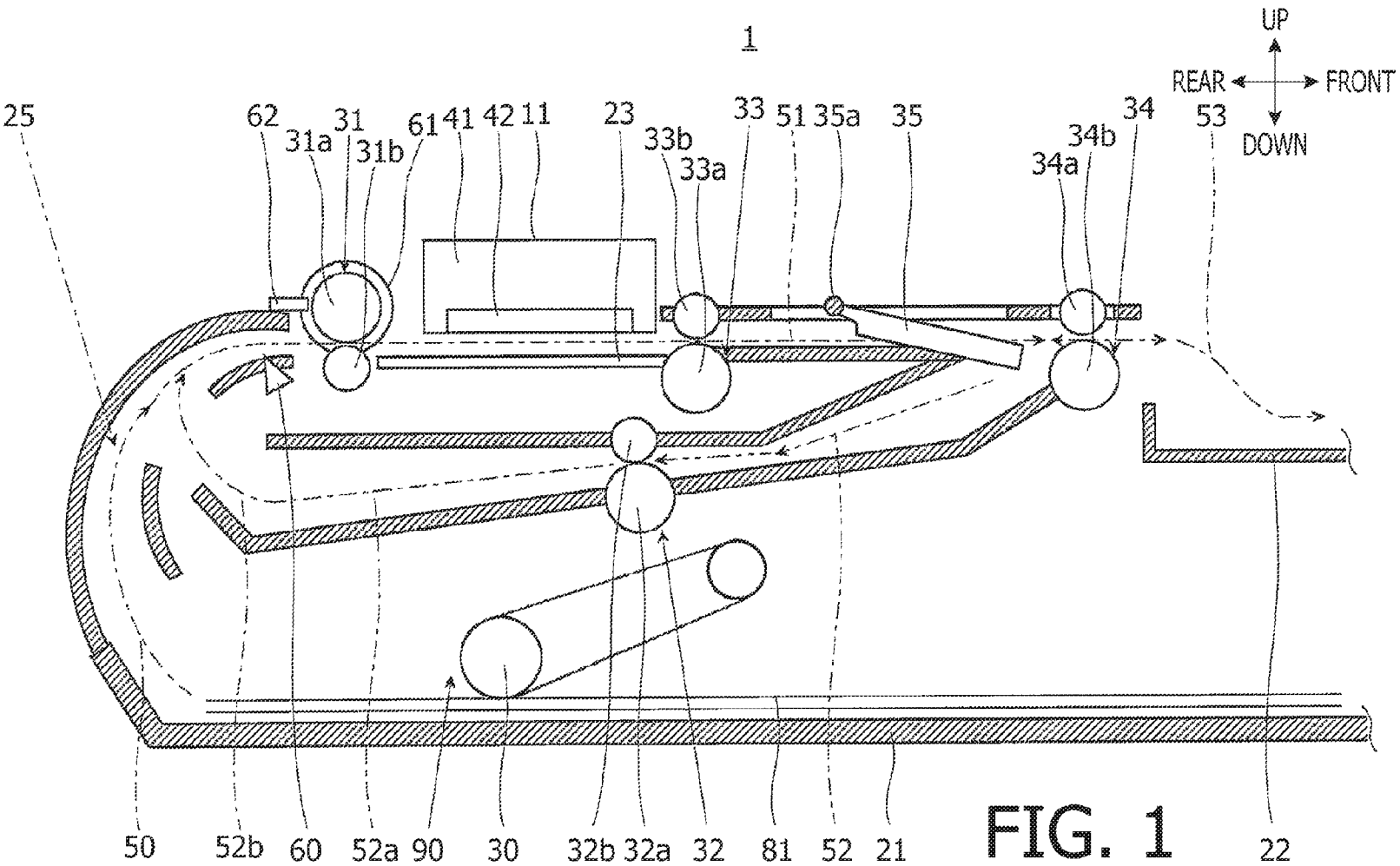
FIG. 1 illustrates an overall configuration of a printing apparatus according to a first embodiment of the present disclosure.

In the following description, directions concerning the printing apparatus 1 and each part or component included in the printing apparatus 1 may be mentioned based on orientations indicated by arrows shown in FIG. 1. For example, a viewer's right-hand side and left-hand side in FIG. 1 are defined as a front side and a rear side, respectively. An upper side and a lower side in FIG. 1 correspond to an upper side and a lower side of the printing apparatus 1 respectively.

As shown in FIG. 1, the printing apparatus 1 in the first embodiment includes a printer unit 11 and a sheet conveyer unit 90. The printer unit 11 includes a printing head 42, which may discharge ink through nozzles (not shown), and a carriage 41. The sheet conveyer unit 90 may convey a sheet 81 along a sheet conveyer path 25, which is formed in the sheet conveyer unit 90. As the printer unit 11 discharges the ink at the sheet 81 conveyed by the sheet conveyer unit 90, an image is printed on the sheet 81.

The sheet conveyer unit 90 includes a feeder tray 21, an ejection tray 22, and a platen 23. In an upper position with respect to the feeder tray 21, disposed is a platen 23, which may be in a shape of a flat plate. In an upper position with respect to the platen 23, disposed is the printer unit 11. The ejection tray 22 is disposed in a frontward position with respect to the platen 23.

The sheet conveyer path 25 in the sheet conveyer unit 90 includes a feeder path 50, a first conveyer path 51, a second conveyer path 52, and a latter path 53, in which the sheet 81 being conveyed may travel.

The feeder path 50 extends from a rear side of the feeder tray 21 to curve upper-frontward to a first conveyer roller unit 31, which will be described later. The first conveyer path 51 is formed in an area between the platen 23 and the printer unit 11 and extends from the first conveyer roller unit 31 to a switchback roller unit 34, which will described later. The latter path 53 extends from an end of the switchback roller unit 34 to the discharge tray 22.

The second conveyer path 52 is formed in a lower position with respect to the first conveyer path 51. The second conveyer path 52 includes a linear path 52*a*, which is a frontward part of the second conveyer path 52, and a curved path 52, which is a rearward part of the second conveyer path 52. The linear path 52*a* is formed to incline downward as it extends rearward. A starting point being a frontward end of the linear path 52*a* is connected with a terminal point of the first conveyer path 51. Meanwhile, a terminal point being a rearward end of the linear path 52*a* is connected with a starting point of the curved path 52*b*. The curved path 52*b* is formed to curve upper-rearward, and a terminal point of the curved path 52*b* is connected with an intermediate point of the feeder path 50.

The printing apparatus 1 includes a feed roller unit 30, the first conveyer roller unit 31, a double-face conveyer roller unit 32, an ejection roller unit 33, the switchback roller unit 34, and a switchback flap 35, which may form at least a part of the sheet conveyer unit 90.

The feed roller unit 30 may be disposed in a straight above position with respect to the feeder tray 21 and may feed the sheet 81 in the feeder tray 21 to the sheet conveyer path 25.

The conveyer roller unit 31 includes a conveyer roller 31*a* and a pinch roller 31*b*. The conveyer roller 31*a* and the pinch roller 31*b* pinch the sheet 81 conveyed by the feed roller unit 30 to the sheet conveyer path 25 from upper and lower sides. Rotation speeds of the conveyer roller unit 31 may be changeable at least between two different rotation speeds. A rotary encoder 61 is arranged coaxially with the conveyer roller 31*a* in the conveyer roller unit 31.

The ejection roller unit 33 includes an ejection roller 33*a* and a spur roller 33*b* and is arranged in the first conveyer path 51 on a downstream side of the printer unit 11 with regard to a conveying direction of the sheet 81, e.g., a frontward direction in the printing apparatus 1. The ejection roller 33*a* and the spur roller 33*b* may pinch the sheet 81 conveyed in the first conveyer path 51 by the conveyer roller unit 31 from upper and lower sides. Rotation speeds of the ejection roller unit 33 may be changeable at least between two different rotation speeds.

The switchback roller unit 34 includes a switchback roller 34*a* and a spur roller 34*b*. The switchback roller 34*a* and the spur roller 34*b* may nip the sheet 81 conveyed in the first conveyer path 51 by the ejection roller unit 33 from upper and lower sides. The switchback roller unit 34 may, on one hand, convey the sheet 81 toward the discharge tray 22 in the conveying direction. On the other hand, the switchback roller unit 34 may convey the sheet 81 toward the second conveyer path 52 in a reverse direction, which is an opposite direction from the conveying direction, e.g., in a rearward direction in the printing apparatus 1. Rotation speeds of the switchback roller unit 34 may be changeable at least between two different rotation speeds. The sheet 81 conveyed through the second conveyer path 52 is inverted upside-down and guided to return to the first conveyer path 51.

The switchback flap 35 is disposed at a position in the first conveyer path 51 between the ejection roller unit 33 and the switchback roller unit 34 and is movable to swing upward or downward about a fixed end 35*a*. The switchback flap 35 may be lifted upward by the sheet 81 being conveyed by the ejection roller unit 33 toward the switchback roller unit 34. As the sheet 81 is conveyed to pass through the switchback flap 35, and a trailing end of the sheet 81 is conveyed to a downstream side of the ejection roller 33 with respect to the conveying direction, the switchback flap 35 returns to a downward inclined posture by its own weight due to the effect of gravity.

In the present embodiment, the reverse direction may not necessarily be the completely inverted direction with respect to the conveying direction. In other words, if the conveying direction is at zero (0) degree, the reverse direction may not necessarily be at 180 degrees or −180 degrees with respect to the conveying direction as long as it contains a component of a reverse direction (e.g., −170 degrees, −160 degrees, 170 degrees, and 160 degrees).

The double-face conveyer roller unit 32 includes a double-face conveyer roller 32*a* and a pinch roller 32*b* and is disposed in the second conveyer 52, or more specifically, in the linear path 52*a*. The double-face conveyer roller 32*a* and the pinch roller 32*b* may pinch the sheet 81 being conveyed in the second conveyer path 52 by the switchback roller unit 34 from upper and lower sides. Rotation speeds of the double-face conveyer roller unit 32 may be changeable at least between two different rotation speeds.

The sheet conveyer unit 90 further includes a registration sensor 60 and a rotary encoder sensor 62. The registration sensor 60 is disposed in the feeder path 50 in the sheet conveyer path 25 at a preceding position, i.e., an upstream and proximate position with regard to the conveying direction, of the conveyer roller unit 31. The registration sensor 60 may output detection signals to a controller 100, which will be described later, in response to presence of the sheet 81 in a position corresponding to the registration sensor 60.

The rotary encoder sensor 62 is disposed in a proximate position from the rotary encoder 61. The rotary encoder sensor 62 may output pulsed signals in response to rotation of the conveyer roller 31*a* and output the pulsed signals to the controller 100.

Figure 2:
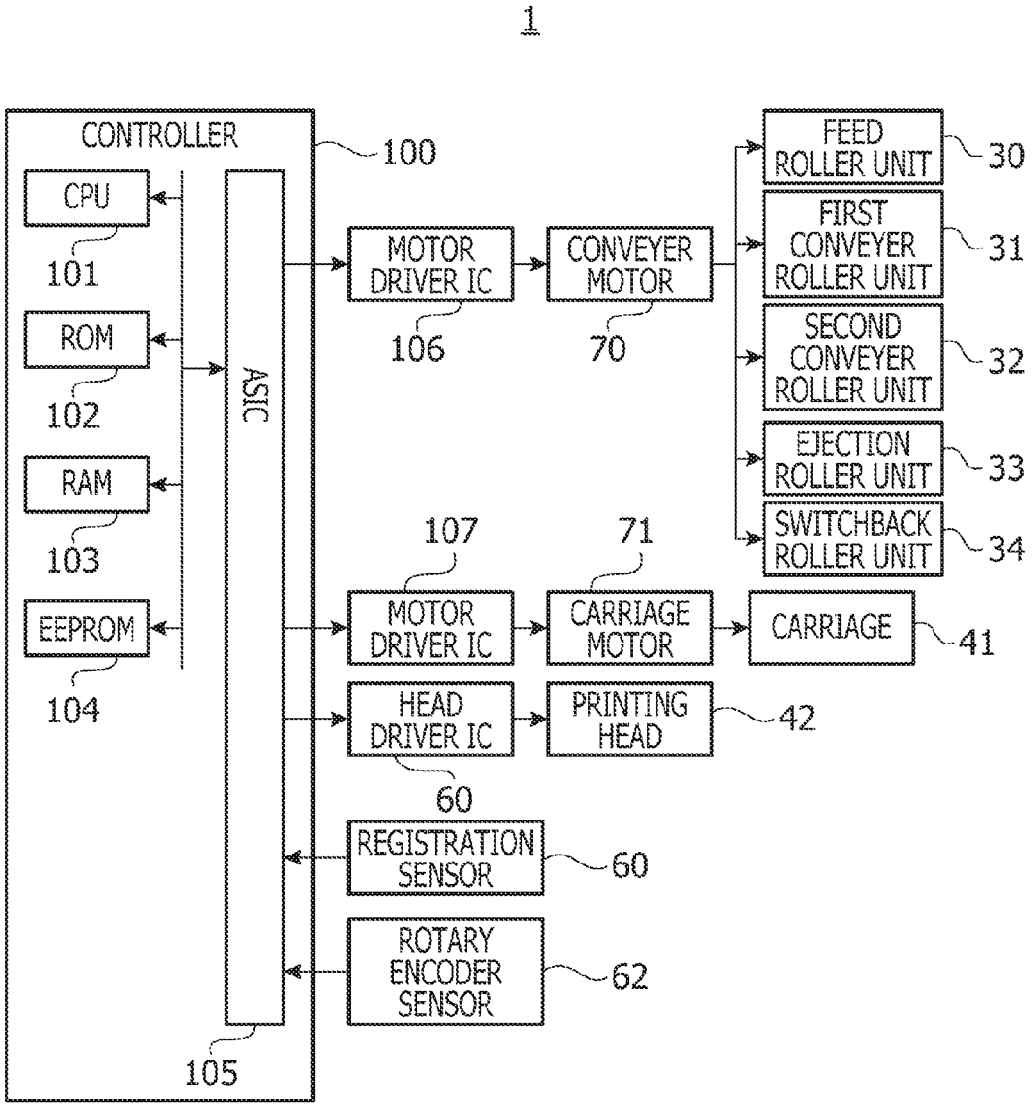
FIG. 2 is a block diagram to illustrate an electrical configuration of the printing apparatus according to the first embodiment of the present disclosure.

Next, electrical configuration of the printing apparatus 1 will be described with reference to FIG. 2.

The controller 100 in the printing apparatus 1 includes a first board and a second board. On the first board, a central processing unit (CPU) 101, a read-only memory (ROM) 102, a random-access memory (RAM) 103, and an electrically erasable programmable ROM (EEPROM) 104 may be mounted. On the second board, an application-specific integrated circuit (ASIC) 105 may be mounted. The first board and the second board may be connected with each other through busses (unsigned). The ASIC 105 may be connected with a motor driver integrated circuits (ICs) 106, 107, a head driver IC 108, the registration sensor 60, and the rotary encoder sensor 62.

The CPU 101 may, when a print job is input from an external device (not shown), such as a personal computer (PC), output a command to execute the print job to the ASIC 105 based on a program stored in the ROM 102. The ASIC 105 receiving the command may activate driver programs according to the command. Thus, the printing operation may be implemented by the controller 100.

The RAM 103 is a memory device to temporarily store various types of information. The RAM 103 may store an amount of the ink ejected from the recording head 42, when the image is printed on one side (e.g., a first face) by the printer unit 11, on a line basis.

The motor driver IC 106 may activate a conveyer motor 70. The conveyer motor 70 being activated may drive the feed roller unit 30, the conveyer roller unit 31, the double-face conveyer roller unit 32, the ejection roller unit 33, and the switchback roller unit 34. Meanwhile, these roller units 30-34 may not necessarily be driven by the single conveyer motor 70 but may be driven by, for example, a plurality of motors.

The motor driver IC 107 may activate a carriage motor 71. The carriage motor 71 being activated may move the carriage 41 in a main scanning direction. The head driver IC 108 may drive the printing head 42. While the printing head 42 is driven, the ink may be ejected out of the printing head 42 through the nozzles.

The controller 100 may receive the signals output from the registration sensor 60 and the rotary encoder sensor 62. Based on the received signals, the controller 100 may control the driver ICs 106-108 to conduct a printing operation. As the controller 100 implements the printing operation, the image may be printed on the sheet 81.

[Behaviors of the Printing Apparatus]

Next, behaviors of the printing apparatus 1 in the first embodiment will be described with reference to FIGS. 1-4. The behaviors of the printing apparatus 1 may be implemented by the controller 100, in particular, the CPU 101, which receives a print job, by reading and running a predetermined program stored in the ROM 102. The controller 100 running the program may control the driver ICs 106-108 to perform processes in the printing operation.

Figure 3:
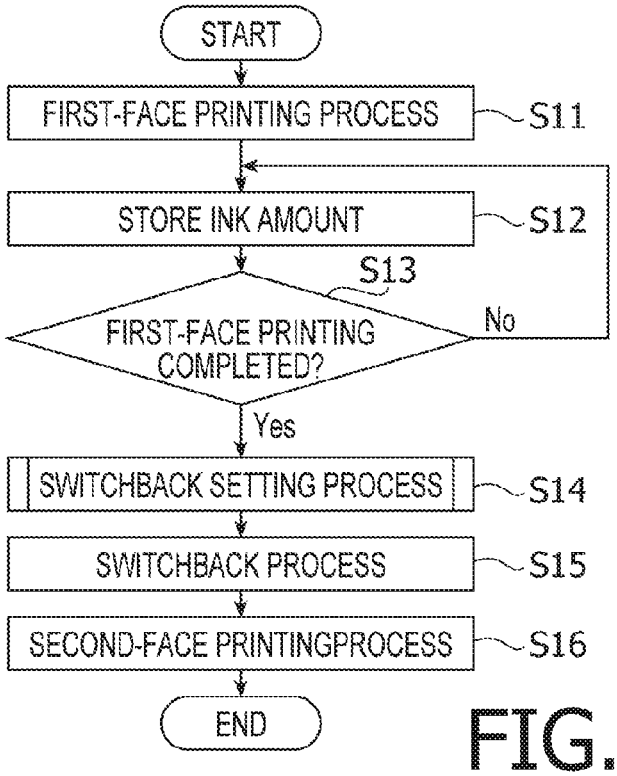
FIG. 3 is a flowchart to illustrate a flow of processes to be executed by a controller in the printing apparatus according to the first embodiment of the present disclosure.
Figure 4:
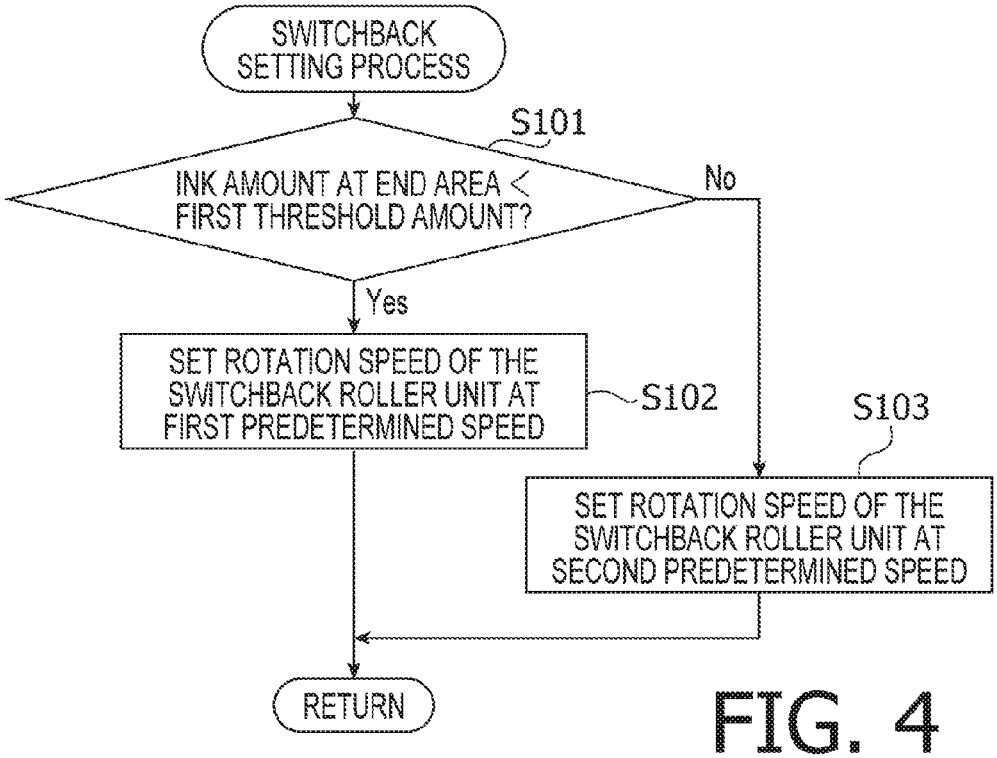
FIG. 4 is a flowchart to illustrate a flow of processes in a switchback process to be executed by the controller in the printing apparatus according to the first embodiment of the present disclosure.

FIG. 3 is a flowchart to illustrate a flow of processes in a double-face printing operation to be executed by the controller 100 in the printing apparatus 1, and FIG. 4 is a flowchart to illustrate a flow of processes in a switchback process in the double-face printing operation to be executed by the controller 100 in the printing apparatus 1, according to the first embodiment of the present disclosure.

The controller 100 may start the double-face printing operation when, for example, a print job to print images on a first face and a second face being an inverted side from the first face of the sheet 81 is transmitted from an external device (not shown) and received by the controller 100.

As the double-face printing operation starts, in S11, as shown in FIG. 3, the controller 100 performs a first-face printing process to print an image on the first face of the sheet 81 according to the received print job.

In the first-face printing process, the controller 100 performs a feeding process, a conveying process, and a discharging process. In particular, the controller 100 may perform the feeding process and thereafter repeat the conveying process and the discharging process alternately.

In the feeding process, the controller 100 activates the conveyer motor 70 through the motor driver IC 106 to drive the feed roller unit 30. Thereby, the sheet 81 in the feeder tray 21 is conveyed by the feed roller unit 30 to the feeder path 50 in the sheet conveyer path 25. The sheet 81 conveyed to the feeder path 50 is further conveyed by the feed roller unit 30 to the conveyer roller unit 31.

Meanwhile, the controller 100 may detect the sheet 81 reaching the conveyer roller unit 31 based on the signals output from the registration sensor 60. If the controller 100 detects the sheet 81 reaching the conveyer roller unit 31, the controller 100 ceases the feeding process and activates the conveying process. In the conveying process, the controller 100 activates the conveyer motor 70 through the motor driver IC 106 to drive the conveyer roller unit 31, the ejection roller unit 33, and the switchback roller unit 34 for a predetermined length of time. Meanwhile, the sheet 81 reaching the conveyer roller unit 31 is conveyed for a predetermined distance in the conveying direction and stops thereat.

The controller 100 ceases the conveying process and starts the discharging process. In the discharging process, the controller activates the carriage motor 71 through the motor driver IC 107 to move the carriage 41 in the main scanning direction. While moving the carriage 41, the controller 100 controls the printing head 42 through the head driver IC 108 to eject the ink through the nozzles and print a line of image.

The controller 100 repeats the conveying process and the discharging process alternately to print lines of images on the sheet 81. In the following description, the conveying process and the discharging process to be repeated for a single sheet 81 may be called as a printing process.

In the meantime, in S12, the controller 100 stores an amount of the ink ejected from the printing head 42 during the printing process in the first-face printing process in the RAM 103.

In S13, the controller 100 determines end of the first-face printing process with the first face of the sheet 81 (S13: YES) and in S14 performs the switchback setting process (see FIG. 4).

In S101, the controller 100 determines, based on the ink amount in the RAM 103 stored during the first-face printing process, whether an amount of the ejected ink at an end area of the sheet 81 is smaller than a first threshold amount. The end area of the sheet 81 refers to an area of the sheet 81, which ranges for a predetermined length (e.g., 2-5 mm) from an upstream or leading end with regard to the reverse direction, e.g., a rear end in FIG. 1, of the sheet 81. The first threshold amount is a preset value, which may be determined through experiments, and indicates an amount of the ink that may decrease rigidity of the sheet 81 at the end area to a predetermined level or lower when the amount of ink is applied to the end area of the sheet 81. When the rigidity of the sheet 81 at the end area is decreased to be the predetermined level or lower, and when the end area of the sheet 81 happens to collide with neighboring items, such as the double-face conveyer roller unit 32, a part of items that form the curved path 52*b*, and the conveyer roller unit 31, the end area of the sheet 81 may be creased or crumpled and may cause sheet jam. Thus, the first threshold amount may be determined in consideration of attempt to avoid sheet jam.

In S101, if the controller 100 determines that the ink amount at the end area on the first face of the sheet 81 is smaller than the first threshold amount (S101: YES), in S102, the controller 100 sets a rotation speed of the conveyer motor 70 so that the switchback roller unit 34 should rotate at a first predetermined speed value. The controller 100 ends the switchback setting process.

The first predetermined speed value corresponds to a rotation speed of the switchback roller unit 34 which is greater than a rotation speed of the switchback roller unit 34 when the ink amount at the end area of the sheet 81 is greater than or equal to the first threshold amount and may be determined in advance through experiments. The first predetermined speed value may indicate, for example, 10 inch per second (ips), 11 ips, 12 ips, 13 ips, or 14 ips.

Meanwhile, in S101, if the controller 100 determines that the ink amount at the end area on the first face of the sheet 81 is greater than or equal to the first threshold amount (S101: NO), in S103, the controller 100 sets a rotation speed of the conveyer motor 70 so that the switchback roller unit 34 should rotate at a second predetermined speed value. The controller 100 ends the switchback setting process.

The second predetermined speed value corresponds to a rotation speed lower than the rotation speed of the switchback roller unit 34 when the ink amount at the end area of the sheet 81 is smaller than the first threshold amount and may be determined in advance through experiments. For example, the second predetermined speed value may be in a range, in which the end area on the first face of the sheet 81 may be restrained from being creased when the ink amount at the end area on the first side of the sheet 81 is greater than or equal to the first threshold amount and when the end area on the first face of the sheet 81 collides with the neighboring part. The second predetermined speed value may indicate, for example, 5 ips, 6 ips, 7 ips, or 8 ips.

Referring back to FIG. 3, in S15, the controller 100 performs a switchback process. In the switchback process, the controller 100 may activate the conveyer motor 70 through the motor driver IC 106 to drive the switchback roller unit 34 to rotate at the rotation speed set in S14. Thereby, the sheet 81 may be conveyed in the reverse direction by the switchback roller unit 34 and the switchback flap 34.

Thus, the sheet 81 is conveyed through the linear path 52*a* to the curved path 52*b* in the second conveyer path 52. While the sheet 81 is conveyed through the curved path 52 and the feeder path 50, the sheet 81 is inverted so that the first face faces downward and a second side being the opposite side from the first face faces upward at the end of the feeder path 50.

Meanwhile, the controller 100 may determine, based on the signals output from the registration sensor 60, that an upstream end of the sheet 81 conveyed through the feeder path 50 reaches the conveyer roller unit 31. Thereafter, in S16, the controller 100 performs a second-face printing process with the second face of the sheet 81. The second-face printing process may be similar to the printing process in the first-face printing process. The controller 100 thereafter ends the double-face printing process.

Thus, in the printing apparatus 1 according to the first embodiment, when the ink amount at the end area on the first face of the sheet 81 is smaller than the first threshold amount, by increasing the rotation speed of the switchback roller unit 34, the sheet 81 may be conveyed to the first conveyer path 51 speedily. Therefore, the printing process with the second face of the sheet 81 may be started in shorter time, and, compared to the conventional printing apparatus, a time period required for entire double-face printing may be shortened.

Further, when the ink amount at the end area on the first face of the sheet 81 is greater than or equal to the first threshold amount, by reducing the rotation speed of the switchback roller unit 34, the sheet 81 may be restrained from being creased or damaged at the end area when the end area collides with the neighboring items, such as the double-face conveyer roller unit 32, a part of items that form the curved path 52*b*, and the conveyer roller unit 31.

[Modified Example 1]

Next, a modified example of the printing apparatus 1 according to the first embodiment will be described with reference to FIG. 5.

[Configuration of the Printing Apparatus]

Figure 5:
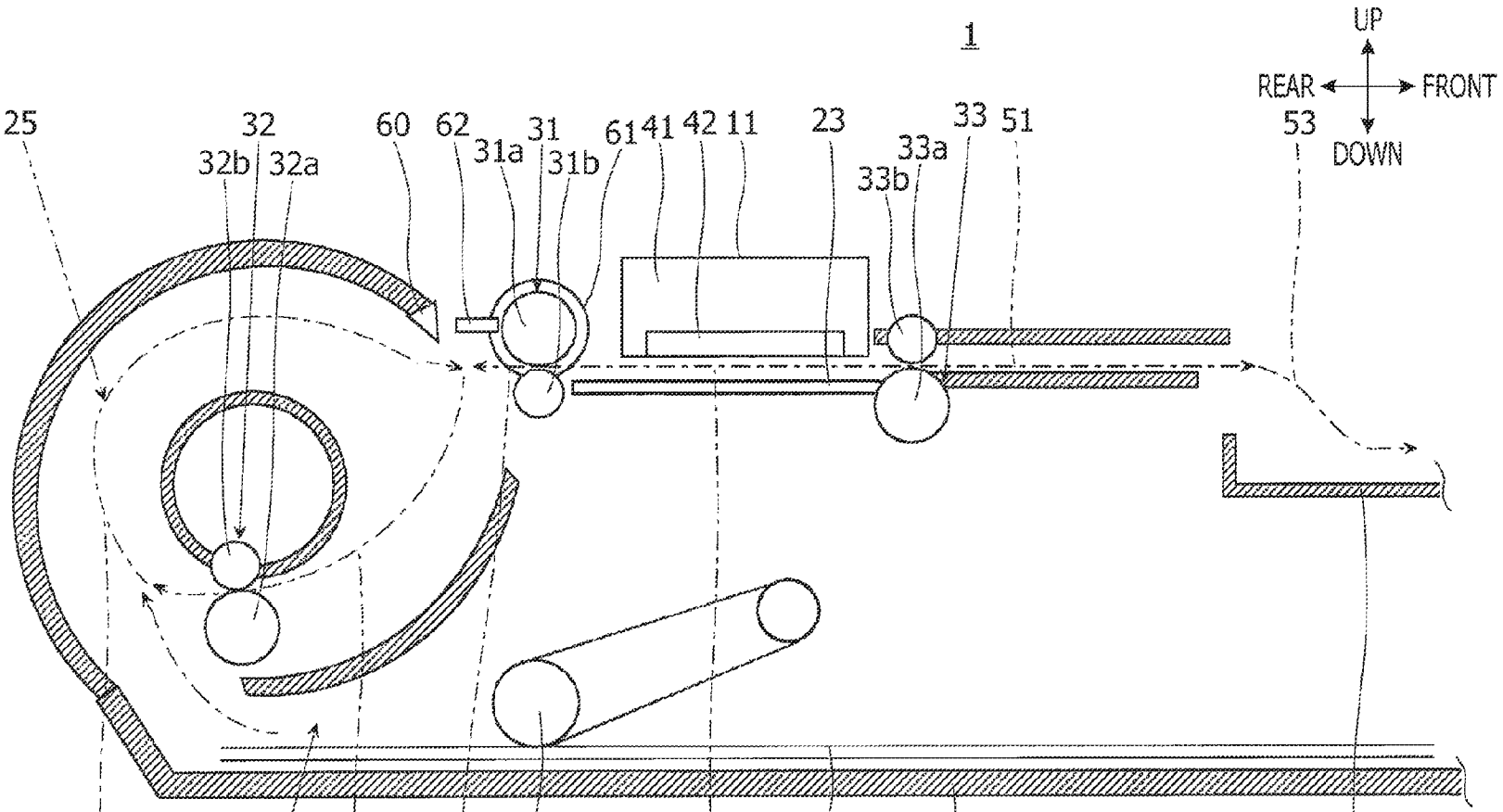
FIG. 5 illustrates an overall configuration of a modified example of the printing apparatus according to the first embodiment of the present disclosure.

As shown in FIG. 5, the printing apparatus 1 may be in the configuration similar to the printing apparatus 1 in the previous embodiment but is different at least in two (2) ways such that the printing apparatus 1 is not provided with the switchback roller unit 34 while the ejection roller unit 33 undertakes the function of the switchback roller unit 34, and that the double-face conveyer roller unit 32 is disposed in the curved path 52*b* in the second conveyer path 52.

Therefore, in the modified example, a part of the path between the conveyer roller unit 31 and the ejection roller unit 33 undertakes the function of the first conveyer path 51 and the linear path 52*a* of the second conveyer path 52.

The printing apparatus 1 modified as above may provide substantially similar usability to the user to the printing apparatus 1 described in the previous embodiment.

Second Embodiment

[Behaviors of the Printing Apparatus]

Figure 6:
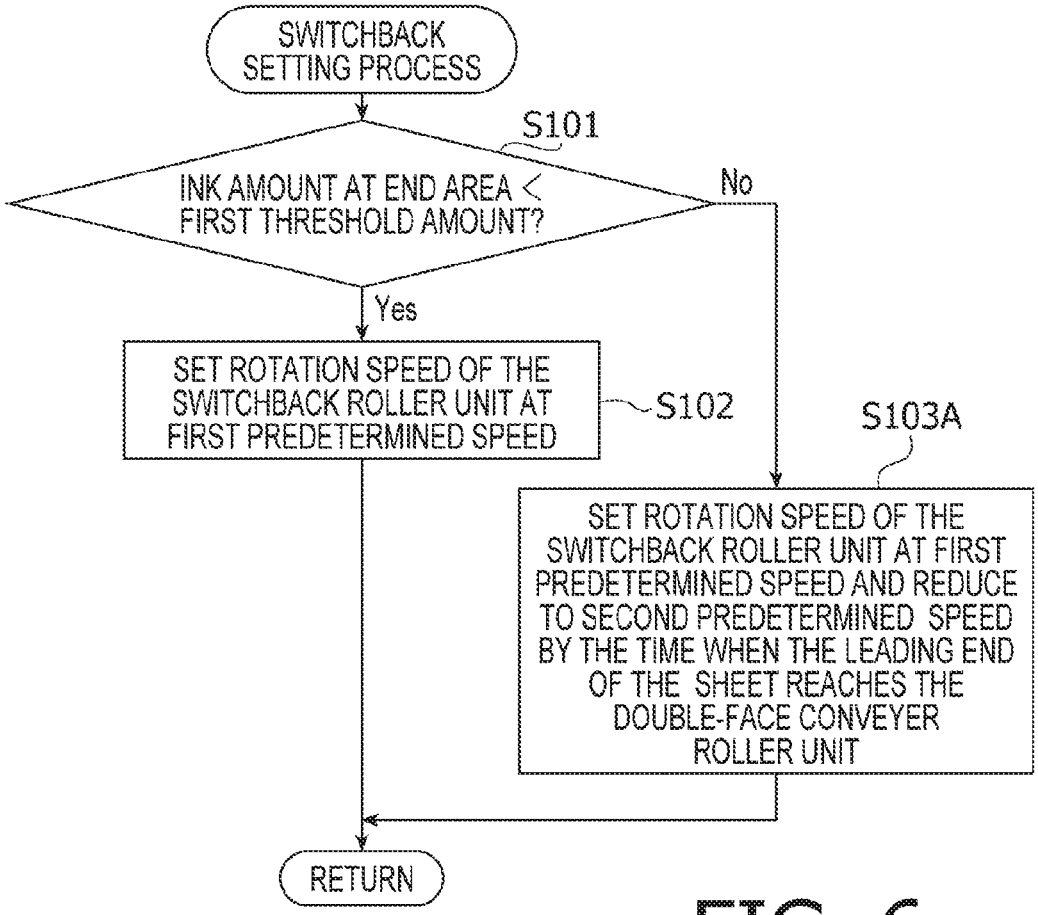
FIG. 6 is a flowchart to illustrate a flow of processes to be executed by the controller in the printing apparatus according to a second embodiment of the present disclosure.

Next, behaviors of the printing apparatus 1 according to a second embodiment will be described with reference to FIG. 6. The printing apparatus 1 in the second embodiment may be in the similar or the same configuration as the printing apparatus 1 described in the first embodiment. In the following description, parts, items, or steps that are identical to those described in the above embodiment will be referred to by same reference signs or step numbers, and redundant explanation of those will be omitted.

The behaviors of the printing apparatus 1 may be implemented by the controller 100, in particular, the CPU 101, which receives a print job, by reading and running a predetermined program stored in the ROM 102. The controller 100 running the program may control the driver ICs 106-108 to perform processes in the printing operation.

The behaviors of the printing apparatus 1 in the second embodiment may be similar to those in the printing operation of the printing apparatus 1 in the first embodiment except for a behavior in the switchback setting process.

In the present embodiment, S103 in the switchback setting process is replaced with S103A. If the controller 100 determines that the ink amount at the end area on the first face of the sheet 81 is greater than or equal to the first threshold amount (S101: NO), in S103A, the controller sets a rotation speed of the conveyer motor 70 so that the switchback roller unit 34 should rotate at the first predetermined speed value. Further, the controller 100 sets the rotation speed of the conveyer motor 70 so that the rotation speed of the switchback roller 34 is reduced to the second predetermined speed value before the end area of the sheet 81 reaches the double-face conveyer roller unit 32.

For example, the controller 100 may set the rotation speed of the conveyer motor 70 so that the rotation speed of the switchback roller unit 34 is maintained at the first predetermined speed value until a first predetermined length of time elapses since activation of the conveyer motor 70. Further, the controller 100 may control the rotation speed of the conveyer motor 70 so that the rotation speed of the switchback roller unit 34 is reduced to the second predetermined speed value after the first predetermined length of time.

The first predetermined length of time may be set in advance through experiments. For example, the first predetermine length of time may be shorter than a time period, which is required for the end area of the sheet 81 to reach the double-face conveyer roller unit 32 when the conveyer motor 70 is driven to rotate the switchback roller 34 at the second predetermined speed value.

For another example, a sensor (not shown), which may be responsive to the leading end of the sheet 81 reaching at a predetermined sensible position and output responsive signals to the controller 100 in response to the presence of the leading end of the sheet 81 at the sensible position, may be disposed at an upstream position, with regard to the reverse direction, from the double-face conveyer roller unit 32 in the second conveyer path 52. With the sensor, the controller 100 may set the rotation speed of the conveyer motor 70 so that the rotation speed of the switchback roller unit 34 is maintained at the first predetermined speed value until the sensor outputs the responsive signal. When the responsive signal output from the sensor is received, the controller 100 may control the rotation speed of the conveyer motor 70 so that the rotation speed of the switchback roller unit 34 is reduced to the second predetermined speed value.

The printing apparatus 1 configured as above may provide substantially similar usability to the user to the printing apparatus 1 described in the previous embodiment.

Meanwhile, according to the printing apparatus 1 in the second embodiment, even when the ink amount at the end area on the first face of the sheet 81 is greater than or equal to the first threshold amount, the rotation speed of the switchback roller unit 34 may be controlled to be greater, compared to the printing apparatus 1 in the first embodiment, until the end area of the sheet 81 reaches the double-face conveyer roller unit 32.

Therefore, compared to the printing apparatus 1 in the first embodiment, in the printing apparatus 1 according to the second embodiment, the sheet 81 may be conveyed to the first conveyer path 51 in shorter time. Therefore, the printing process with the second face of the sheet 81 may be started in shorter time, and a time period required for entire double-face printing may be shortened.

Third Embodiment

[Behaviors of the Printing Apparatus]

Next, behaviors of the printing apparatus 1 in a third embodiment will be described with reference to FIG. 7. The printing apparatus 1 in the third embodiment may be in the similar or the same configuration as the printing apparatus 1 described in the first embodiment.

The behaviors of the printing apparatus 1 may be implemented by the controller 100, in particular, the CPU 101, which receives a print job, by reading and running a predetermined program stored in the ROM 102. The controller 100 running the program may drive the driver ICs 106-108 to perform processes in the printing operation.

The behaviors of the printing apparatus 1 in the third embodiment may be similar to those in the printing operation of the printing apparatus 1 in the first embodiment except for a behavior in the switchback setting process.

Figure 7:
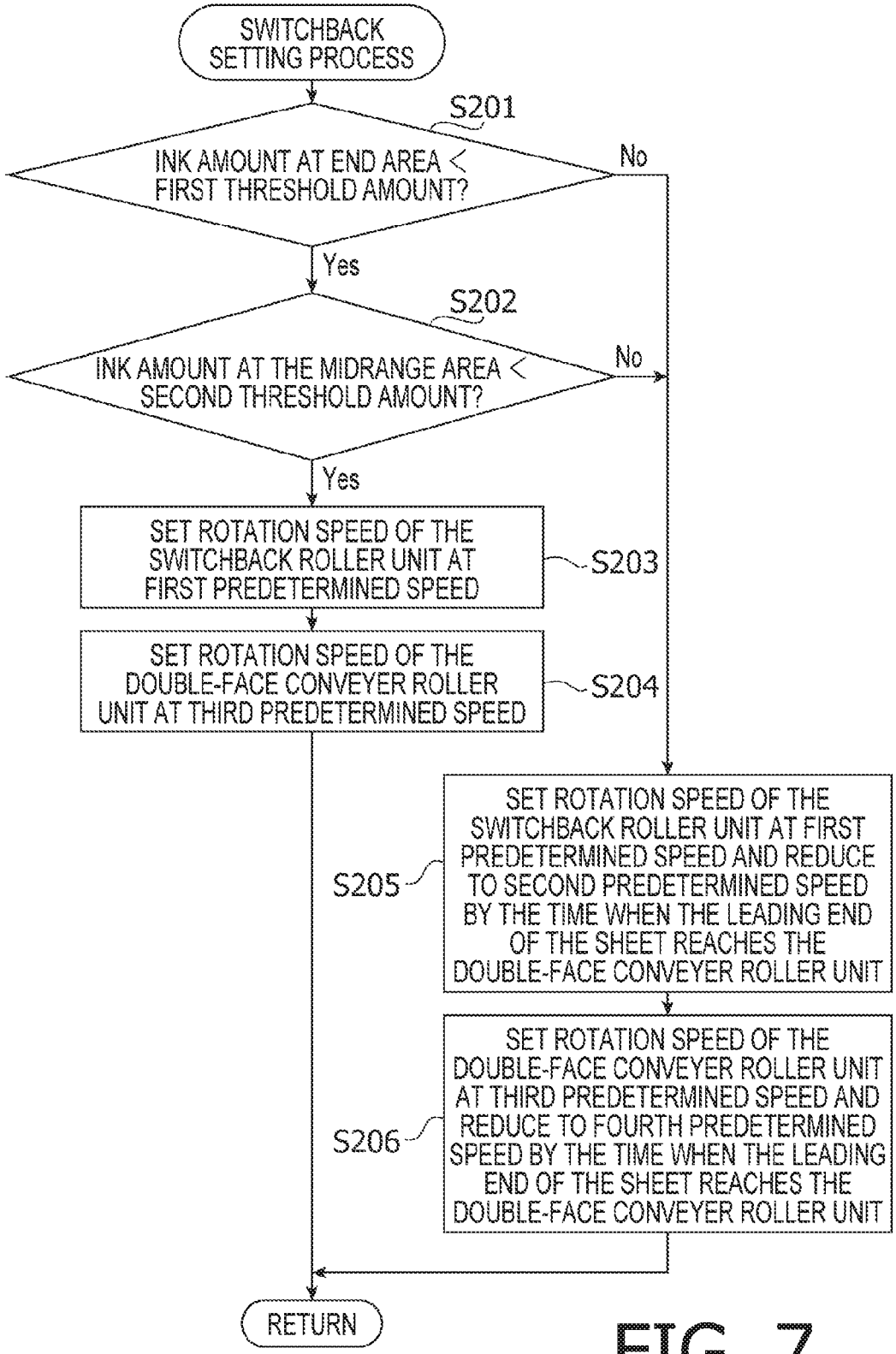
FIG. 7 is a flowchart to illustrate a flow of processes to be executed by the controller in the printing apparatus according to a third embodiment of the present disclosure.

In the switchback setting process, in S201, as shown in FIG. 7 the controller 100 determines, based on the amount of the ink in the RAM 103 stored during the first-face printing process, whether an amount of the ejected ink at the end area on the first face of the sheet 81 is smaller than the first threshold amount.

If the controller 100 determines that the ink amount at the end area on the first face in the sheet 81 is smaller than the first threshold amount (S201: YES), the controller 100 proceeds to S202. If the controller 100 determines that the ink amount at the end area on the first face of the sheet 81 is greater than or equal to the first threshold amount (S201: NO), the controller 100 proceeds to S205, which will be described later.

In S202, the controller 100 determines, based on the ink amount in the RAM 103 stored during the first-face printing process, whether an ink amount at a midrange area on the first face of the sheet 81 is smaller than a second threshold amount.

The midrange area of the sheet 81 refers to an area on the first face of the sheet 81, which ranges downstream for a length equivalent to the curved path 52*b* from the end area with regard to the reverse direction. The second threshold amount is a preset value, which may be determined in advance through experiments, and indicates an amount of the ink that may decrease rigidity of the sheet 81 at the midrange area to a predetermined level or lower when that amount of ink is applied to the midrange area of the sheet 81. When the rigidity of the sheet 81 at the midrange area is decreased to be the predetermined level or lower, and when the midrange area of the sheet 81 is in the curved path 52*b*, the midrange area of the sheet 81 may be creased or collapse and may cause sheet jam. Thus, the second predetermined value may be determined in consideration of attempt to avoid the sheet jam.

In S202, if the controller 100 determines that the ink amount at the midrange area on the first face of the sheet 81 is smaller than the second threshold amount (S202: YES), in S203, the controller 100 sets a rotation speed of the conveyer motor 70 so that the switchback roller unit 34 should rotate at the first predetermined speed value. Further, in S204, the controller 100 sets the rotation speed of the conveyer motor 70 so that the double-face conveyer roller unit 32 should rotate at a third predetermined speed value. The controller 100 ends the switchback setting process.

The third predetermined speed value corresponds to a rotation speed higher than a rotation speed of the double-face conveyer roller unit 32 to convey the sheet 81 beyond the double-face conveyer unit 32, i.e., after the end area of the sheet 81 reached the double-face conveyer unit 32, and may be determined in advance through experiments. The third predetermined speed value may indicate, for example, 10 ips, 11 ips, 12 ips, 13 ips, or 8 ips. The third predetermined speed value may be either the same as or different from the first predetermined speed value.

According to the present embodiment, the controller 100 may perform S203 and S204 in an inverted order or may perform S203 and S204 simultaneously.

Meanwhile, in S202, if the controller 100 determines that the ink amount at the midrange area in the sheet 81 is greater than or equal to the second threshold amount (S202: NO), the controller 100 proceeds to S205. In S205, the controller 100 sets a rotation speed of the conveyer motor 70 so that the switchback roller unit 34 should rotate at the first predetermined speed value. Further, the controller 100 sets the rotation speed of the conveyer motor 70 so that the rotation speed of the switchback roller 34 is reduced to the second predetermined speed value before the end area of the sheet 81 reaches the double-face conveyer roller unit 32.

Thereafter, in S206, the controller 100 sets the rotation speed of the conveyer motor 70 so that the double-face conveyer roller unit 32 should rotate at the third predetermined speed value. Further, the controller 100 sets the rotation speed of the conveyer motor 70 so that the rotation speed of the double-face conveyer roller 32 is reduced to a fourth predetermined speed value before the end area of the sheet 81 reaches the double-face conveyer roller unit 32. The controller 100 ends the switchback setting process.

The fourth predetermined speed value corresponds to a rotation speed lower than the rotation speed of the switchback roller unit 34 when the ink amount at the midrange area of the sheet 81 is smaller than the second threshold amount and may be determined in advance through experiments. For example, the fourth predetermined speed value may be in a range, in which the midrange area of the sheet 81 may be restrained from collapsing or being creased when the ink amount at the midrange area of the sheet 81 is greater than or equal to the second threshold amount and when the midrange area of the sheet 81 is in the curved path 52*b*. The fourth predetermined speed value may indicate, for example, 5 ips, 6 ips, 7 ips, or 8 ips. The fourth predetermined speed value may be either the same as or different from the second predetermined speed value.

According to the present embodiment, the controller 100 may perform S205 and S206 in an inverted order or may perform S205 and S206 simultaneously The printing apparatus 1 configured as above may provide substantially similar usability to the user to the printing apparatus 1 described in the previous embodiments.

Meanwhile, according to the printing apparatus 1 in the third embodiment, when the ink amount at the midrange area of the sheet 81 is smaller than the second threshold amount, by increasing the rotation speed of the double-face conveyer roller unit 32, the sheet 81 may be conveyed to the first conveyer path 51 in shorter time.

Therefore, the printing process with the second face of the sheet 81 may started in shorter time, and, compared to the conventional printing apparatus, a time period required for entire double-face printing may be shortened.

Further, when the ink amount at the midrange area on the first face of the sheet 81 is greater than or equal to the second threshold amount, by reducing the rotation speed of the double-face conveyer roller unit 32, the sheet 81 may be restrained from collapsing or being creased at the midrange area when the midrange area of the sheet 81 is in the curved path 52*b*.

Fourth Embodiment

[Behaviors of the Printing Apparatus]

Figure 8:
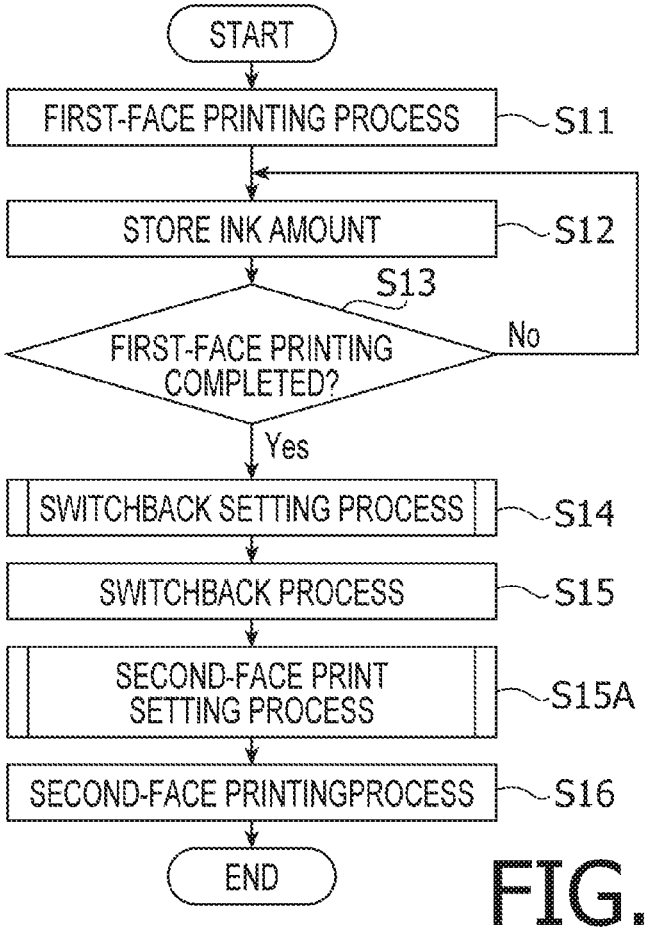
FIG. 8 is a flowchart to illustrate a flow of processes to be executed by the controller in the printing apparatus according to a fourth embodiment of the present disclosure.

Next, behaviors of the printing apparatus 1 in a fourth embodiment will be described with reference to FIGS. 8-9. The printing apparatus 1 in the fourth embodiment may be in the similar or same configuration as the printing apparatus 1 described in the first embodiment.

The behaviors of the printing apparatus 1 may be implemented by the controller 100, in particular, the CPU 101, which receives a print job, by reading and running a predetermined program stored in the ROM 102. The controller 100 running the program may drive the driver ICs 106-108 to perform processes in the printing operation.

The behaviors of the printing apparatus 1 in the fourth embodiment may be similar to those in the printing operation of the printing apparatus 1 in the first embodiment except for a behavior of a second-face print setting process in S15A (see FIG. 8), which is performed after the switchback process in S15 in the double-face printing operation. The behavior in S15A will be described below with reference to FIG. 9.

Figure 9:
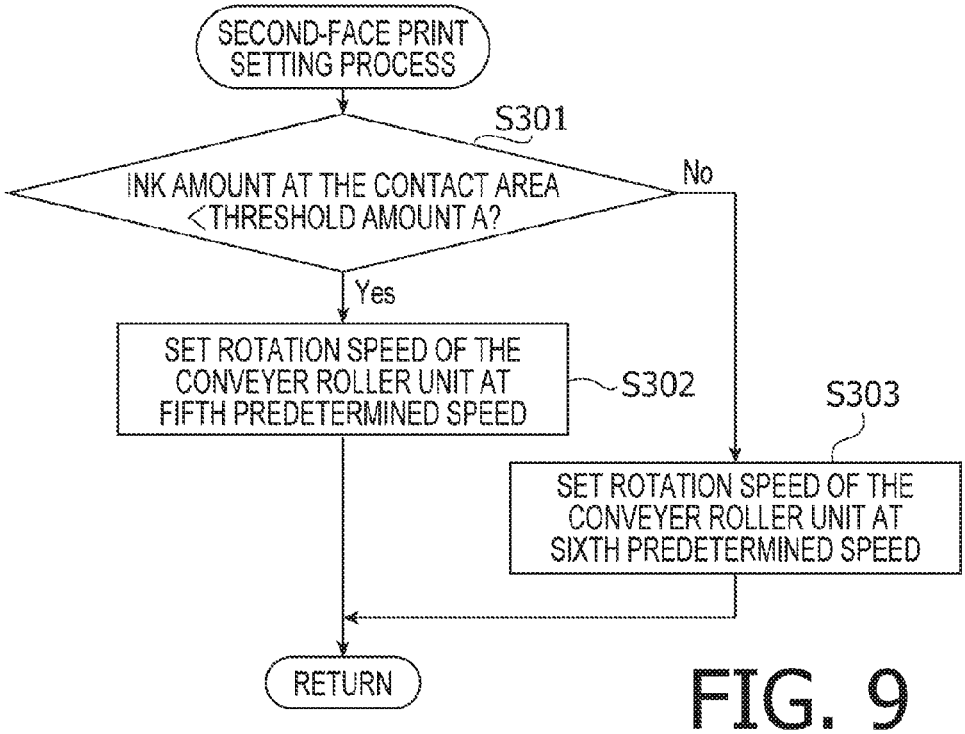
FIG. 9 is a flowchart to illustrate a flow of processes in a second-face print setting process to be executed by the controller in the printing apparatus according to the fourth embodiment of the present disclosure.

In the second-face print setting process, as shown in FIG. 9, in S301, the controller 100 determines an ink amount at a contact area, which may contact the conveyer roller unit 31 while the sheet 81 is being conveyed, on the first face of the sheet 81 is smaller than a threshold amount A. The threshold amount A is a preset amount, which may be determined through experiments. The threshold amount A indicates an amount of the ink in a range, in which the contact area of the sheet 81 may be restrained from being creased even when the contact area of the sheet 81 with that amount of ink contacts the conveyer roller unit 31.

In S301, if the controller 100 determines that the ink amount at the contact area on the first face of the sheet 81 is smaller than the threshold amount A (S301: YES), in S302, the controller 100 sets a rotation speed of the conveyer motor 70 so that the conveyer roller unit 31 should rotate at a fifth predetermined speed value. The controller 100 ends the second-face print setting process.

The fifth predetermined speed value corresponds to a rotation speed higher than a rotation speed of the conveyer roller unit 31 when the ink amount at the contact area on the first side of the sheet 81 is greater than or equal to the threshold amount A and may be determined in advance through experiments. The fifth predetermined speed value may indicate, for example, 10 ips, 11 ips, 12 ips, 13 ips, or 14 ips.

Meanwhile, in S301, if the controller 100 determines that the ink amount at the contact area on the first face of the sheet 81 is greater than or equal to the threshold amount A (S301: NO), in S303, the controller 100 sets a rotation speed of the conveyer motor 70 so that the conveyer roller unit 31 should rotate at a sixth predetermined speed value. The controller 100 ends the second-face print setting process.

The sixth predetermined speed value corresponds to a rotation speed lower than the rotation speed of the conveyer roller unit 31 when the ink amount at the contact area on the first side of the sheet 81 is smaller than the threshold amount A and may be determined in advance through experiments. For example, the sixth threshold amount may be in a range, in which the contact area on the first side of the sheet 81 may be restrained from being creased when the ink amount at the contact area on the first side of the sheet 81 is greater than or equal to the threshold amount A. The sixth predetermined speed value may indicate, for example, 5 ips, 6 ips, 7 ips, or 8 ips.

The controller 100 activates the conveyer motor 70 through the motor driver IC 106 to drive the conveyer roller unit 31 at the rotation speed set in the second-face print setting process in S15A. Thereafter, in S16, the controller 100 performs the second-face printing process to print an image on the second side of the sheet 81.

Thus, in the printing apparatus 1 according to the fourth embodiment, when the ink amount at the contact area on the first face of the sheet 81 is smaller than the threshold amount A, by increasing the rotation speed of the conveyer roller unit 31, the sheet 81 may be conveyed speedily. Therefore, the printing process with the second face of the sheet 81 may be performed in shorter time.

Further, when the ink amount at the contact area on the first face of the sheet 81 is greater than or equal to the threshold amount A, by reducing the rotation speed of the conveyer roller unit 31, the sheet 81 may be restrained from being creased at the contact area when the sheet 81 contacts the conveyer roller unit 31 at the contact area.

Fifth Embodiment

[Behaviors of the Printing Apparatus]

Figure 10:
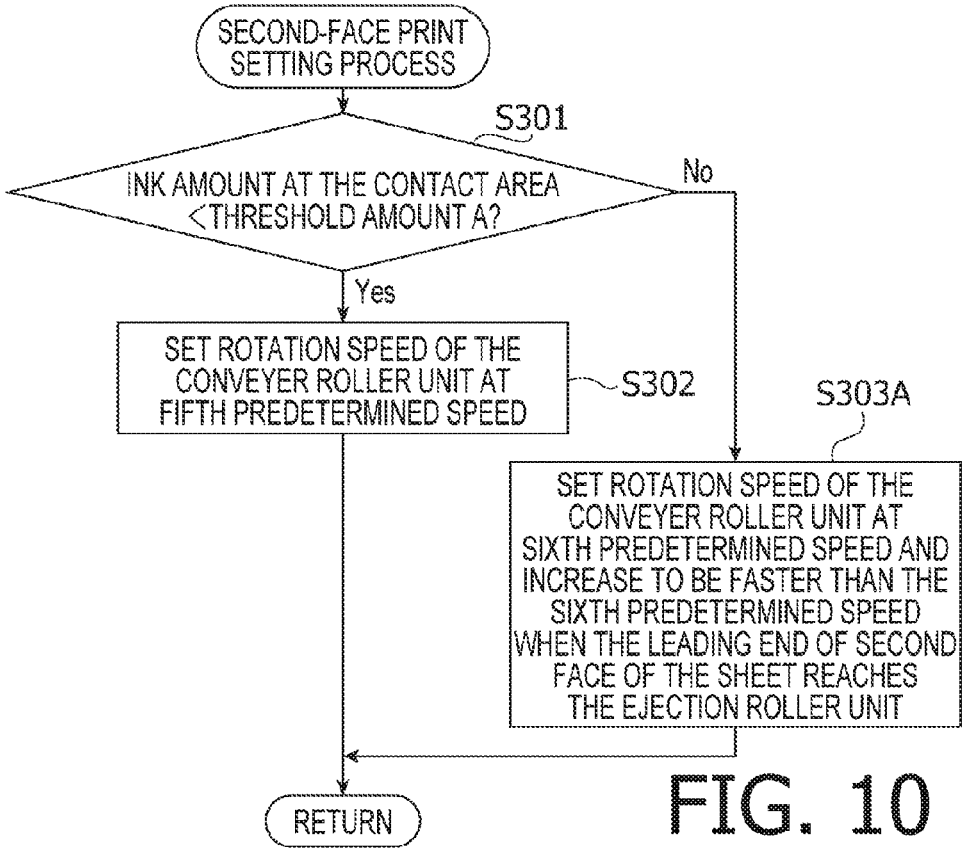
FIG. 10 is a flowchart to illustrate a flow of processes to be executed by the controller in the printing apparatus according to a fifth embodiment of the present disclosure.

Next, behaviors of the printing apparatus 1 in a fifth embodiment will be described with reference to FIG. 10. The printing apparatus 1 in the fifth embodiment may be in the similar or the same configuration as the printing apparatus 1 described in the first embodiment.

The behaviors of the printing apparatus 1 may be implemented by the controller 100, in particular, the CPU 101, which receives a print job, by reading and running a predetermined program stored in the ROM 102. The controller 100 running the program may drive the driver ICs 106-108 to perform processes in the printing operation.

The behaviors of the printing apparatus 1 in the fifth embodiment may be similar to those in the printing operation of the printing apparatus 1 in the fourth embodiment except for a behavior of the second-face print setting process. The behavior in the second-face print setting process according to the fifth embodiment will be described below with reference to FIG. 10.

In the present embodiment, S303 (FIG. 9) in the second-face print setting process is replaced with S303A. If the controller 100 determines that the ink amount at the contact area on the first face of the sheet 81 is greater than equal to the threshold amount A (S303: NO), in S303A, the controller 100 sets a rotation speed of the conveyer motor 70 so that the conveyer roller unit 31 should rotate at a sixth predetermined speed value.

Further, the controller 100 sets the rotation speed of the conveyer motor 70 so that the rotation speed of the conveyer roller unit 31 is increased to be greater than the sixth predetermined speed value when an upstream or leading end on the second face of the sheet 81, with regard to the conveying direction when an image is printed on the second side of the sheet 81, reaches the ejection roller unit 33.

For example, the controller 100 may set the rotation speed of the conveyer motor 70 so that the rotation speed of the conveyer roller unit 31 is maintained at the sixth predetermined speed value until a second predetermined length of time since activation of the conveyer motor 70 elapses. Thereafter, the controller 100 may control the rotation speed of the conveyer motor 70 so that the rotation speed of the conveyer roller unit 31 is reduced to be lower than the sixth predetermined speed value after the second predetermined length of time.

The second predetermined length of time may be set in advance through experiments. For example, the second predetermine length of time may be set to be longer than or equal to a time period, which is required for the leading end of the second face of the sheet 81 to reach the ejection roller unit 33 when the conveyer motor 70 is driven to rotate the conveyer roller unit 31 at the sixth predetermined speed value.

The printing apparatus 1 configured as above may provide substantially similar usability to the user to the printing apparatus 1 described in the fourth embodiment.

Meanwhile, according to the printing apparatus 1 in the fifth embodiment, even when the ink amount at the contact area on the first face of the sheet 81 is greater than or equal to the threshold amount A, the rotation speed of the conveyer roller unit 31 may be controlled to be greater, compared to the printing apparatus 1 in the fourth embodiment, once the leading end on the second face of the sheet 81 reaches the ejection roller unit 33 regardless of the ink amount at the contact area on the first face of the sheet 81.

Therefore, compared to the printing apparatus 1 in the fourth embodiment, in the printing apparatus 1 according to the fifth embodiment, the printing process with the second face of the sheet 81 may performed in shorter time, and a time period required for double-face printing may be shortened.

Sixth Embodiment

[Behaviors of the Printing Apparatus]

Next, behaviors of the printing apparatus 1 in a sixth embodiment will be described with reference to FIG. 11. The printing apparatus 1 in the sixth embodiment may be in the similar or the same configuration as the printing apparatus 1 described in the first embodiment.

The behaviors of the printing apparatus 1 may be implemented by the controller 100, in particular, the CPU 101, which receives a print job, by reading and running a predetermined program stored in the ROM 102. The controller 100 running the program may drive the driver ICs 106-108 to perform processes in the printing operation.

The behaviors of the printing apparatus 1 in the sixth embodiment may be similar to those in the printing operation of the printing apparatus 1 in the fourth embodiment except for a behavior of the second-face print setting process. The behavior in the second-face print setting process according to the sixth embodiment will be described below with reference to FIG. 11.

Figure 11:
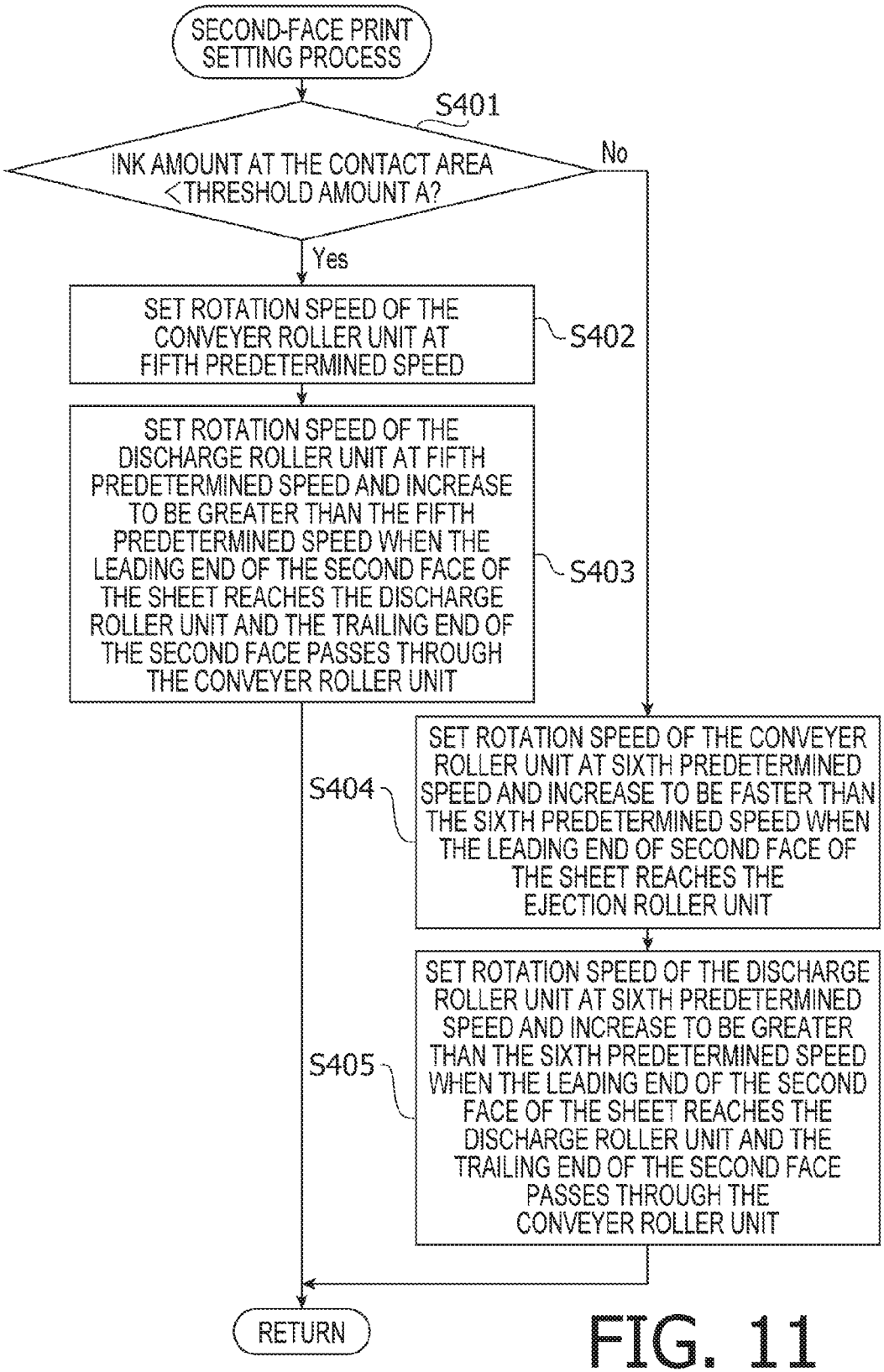
FIG. 11 is a flowchart to illustrate a flow of processes to be executed by the controller in the printing apparatus according to a sixth embodiment of the present disclosure.

In the present embodiment, as shown in FIG. 11, in S401, the controller 100 determines an ink amount at the contact area on the first face of the sheet 81 is smaller than the threshold amount A.

If the controller 100 determines that the ink amount at the contact area on the first side of the sheet 81 is smaller than the threshold amount A (S401: YES), in S402, the controller 100 sets a rotation speed of the conveyer motor 70 so that the conveyer roller unit 31 should rotate at the fifth predetermined speed value.

Thereafter, the controller 100 sets a rotation speed of the ejection roller unit 33 at the fifth predetermined speed value. Further, after the leading end (e.g., the frontward end) of the second face of the sheet 81 reaches the ejection roller unit 33 and after a trailing end (a rearward end) of the second face of the sheet 81 passes through the conveyer roller unit 31, the controller performs S403. In S403, the controller 100 sets the rotation speed of the ejection roller unit 33 at a seventh predetermined speed value, which indicates a higher speed than the fifth predetermined speed value.

For example, the controller 100 may set the rotation speed of the conveyer motor 70 so that the rotation speed of the ejection roller unit 33 is maintained at the fifth predetermined speed value until a third predetermined length of time since the activation of the conveyer motor 70 elapses. Further, the controller 100 may control the rotation speed of the conveyer motor 70 so that the rotation speed of the ejection roller unit 33 is increased to the seventh predetermined speed value after the third predetermine length of time.

The third predetermined length of time may be preset in advance through experiments. For example, the third predetermine length of time may be set to be longer than or equal to a time period, which is required for the leading end of the second face of the sheet 81 to reach the ejection roller unit 33 when the conveyer motor 70 is driven to rotate the conveyer roller unit 31 at the fifth predetermined speed value and until the trailing end of the second face of the sheet 91 passes through the conveyer roller unit 31.

The seventh predetermined speed value may be, for example, greater than an absolute value of the rotation speed of the ejection roller unit 33 when the sheet 81 is switched back in the second conveyer path 52. For another example, the seventh predetermined speed value may be greater than an absolute value of the first predetermine speed or may be greater than an absolute value of the third predetermined speed. The seventh predetermined speed value may indicate, for example, 20 ips, 22 ips, 25 ips, or 27 ips.

Meanwhile, in S401, if the controller 100 determines that the ink amount at the contact area on the first face of the sheet 81 is greater than or equal to the threshold amount A (S401: NO), the controller 100 sets the conveyer motor 70 so that the conveyer roller unit 31 should rotate at the sixth predetermined speed value. When the leading end of the second face of the sheet 81 reaches the ejection roller unit 33, in S404, the controller 100 sets a rotation speed of the conveyer motor 70 so that the conveyer roller unit 31 should rotate at a higher rotation speed than the sixth predetermined speed value.

Next, the controller 100 sets the rotation speed of the ejection roller unit 33 at the sixth predetermined speed value. Further, after the leading end of the second face of the sheet 81 reaches the ejection roller unit 33 and after the trailing end of the second face of the sheet 81 passes through the conveyer roller unit 31, the controller performs S405. In S405, the controller 100 sets the rotation speed of the ejection roller unit 33 at an eighth predetermined speed value, which indicates a higher speed than the sixth predetermined speed value.

For example, the controller 100 may set the rotation speed of the conveyer motor 70 so that the rotation speed of the ejection roller unit 33 is maintained at the sixth predetermined speed value until a fourth predetermined length of time since the activation of the conveyer motor 70 elapses. Further, the controller 100 may control the rotation speed of the conveyer motor 70 so that the rotation speed of the ejection roller unit 33 is increased to the eighth predetermined speed value after the fourth predetermine length of time.

The fourth predetermined length of time may be preset in advance through experiments. For example, the fourth predetermine length of time may be set to be longer than or equal to a time period, which is required for the leading end of the second face of the sheet 81 to reach the ejection roller unit 33 when the conveyer motor 70 is driven to rotate the conveyer roller unit 31 at the sixth predetermined speed value and until the trailing end of the second face of the sheet 91 passes through the conveyer roller unit 31.

The eighth predetermined speed value may be, for example, greater than an absolute value of the rotation speed of the ejection roller unit 33 when the sheet 81 is switched back in the second conveyer path 52. For another example, the eighth predetermined speed value may be greater than an absolute value of one of the first through fourth predetermine speed values. The eighth predetermined speed value may indicate, for example, 20 ips, 22 ips, 25 ips, or 27 ips.

The printing apparatus 1 configured as above may provide substantially similar usability to the user to the printing apparatus 1 described in the fourth embodiment.

Meanwhile, according to the printing apparatus 1 in the sixth embodiment, even when the ink amount at the contact area on the first face of the sheet 81 is greater than or equal to the threshold amount A, the rotation speed of the conveyer roller unit 31 may be controlled to be greater, compared to the printing apparatus 1 in the fourth embodiment, when the leading end on the second face of the sheet 81 reaches the ejection roller unit 33.

Therefore, compared to the printing apparatus 1 in the fourth embodiment, in the printing apparatus 1 according to the sixth embodiment, the printing process with the second face of the sheet 81 may performed in shorter time, and a time period required for entire double-face printing may be shortened.

Further, according to the printing apparatus 1 in the sixth embodiment, when the leading end of the second face of the sheet 81 reaches the ejection roller unit 33 and the trailing end of the second face of the sheet 81 passes through the conveyer roller unit 31, the ejection roller unit 33 is controlled to rotate at the higher rotation speed.

Therefore, in the printing apparatus 1 according to the sixth embodiment, the printing process with the second face of the sheet 81 may performed in shorter time, and a time period required for entire double-face printing may be shortened.

Although examples of carrying out the disclosure have been described, those skilled in the art will appreciate that there are numerous variations and permutations of the printing apparatus that fall within the spirit and scope of the disclosure as set forth in the appended claims. It is to be understood that the subject matter defined in the appended claims is not necessarily limited to the specific features or act described above. Rather, the specific features and acts described above are disclosed as example forms of implementing the claims.

What is claimed is:

1. A printing apparatus, comprising:

a sheet conveyer unit configured to convey a sheet;

a printer unit configured to discharge ink and print an image on the sheet being conveyed in a conveying direction by the sheet conveyer unit; and a controller configured to control the printer unit and the sheet conveyer unit according to a print job, wherein the sheet conveyer unit comprises a first roller unit disposed at a downstream position from the printer unit with regard to the conveying direction;

wherein a first conveyer path, in which the sheet conveyed by the first roller unit in the conveying direction with the image printed thereon by the printer unit travels, and a second conveyer path, in which the sheet conveyed by the first conveyer roller unit in a reverse direction travels to be inverted and is guided to return to the first conveyer path, are formed in the sheet conveyer unit;

wherein the controller is configured to execute:

a first-face printing process, in which the image is printed by the printer unit according to the print job on a first face of the sheet being conveyed in the first conveyer path in the conveying direction;

a switchback process, in which the sheet after the first-face printing process is conveyed in the reverse direction by the first roller unit through the second conveyer path to be returned to the first conveyer path;

a second-face printing process, in which the image is printed by the printer unit according to the print job on a second face of the sheet returned to and conveyed in the first conveyer path along the conveying direction;

a first ink amount determining process, in which whether a discharged ink amount being an amount of ink having been discharged in the first-face printing process at an end area including a leading end of the sheet with regard to the reverse direction is smaller than a first threshold amount is determined; and a switchback setting process, in which, based on a determination in the first ink amount determining process that the discharged ink amount at the end area is smaller than the first threshold amount, the controller sets a rotation speed of the first roller unit for the switchback process to be a first higher rotation speed higher than a first lower rotation speed, and, based on a different determination in the first ink amount determining process that the discharged ink amount at the end area is not smaller than the first threshold amount, the controller sets the rotation speed of the first roller unit to be the first lower rotation speed.

2. The printing apparatus according to claim 1, wherein the sheet conveyer unit further comprises a second roller unit disposed at an intermediate position in the second conveyer path; and wherein, based on the different determination in the first ink amount determining process that the discharged ink amount at the end area is not smaller than the first threshold amount, the controller in the switchback setting process sets the rotation speed of the first roller unit for the switchback process to be reduced to the first lower rotation speed by the time when the end area of the sheet being conveyed in the second conveyer path reaches the second conveyer roller unit.

3. The printing apparatus according to claim 2, wherein, based on the different determination in the first ink amount determining process that the discharged ink amount at the end area is not smaller than the first threshold amount, the controller in the switchback setting process sets the rotation speed of the first roller unit for conveying the sheet until the end area of the sheet reaches the second conveyer unit at the first higher rotation speed and sets the rotation speed of the first roller unit for conveying the sheet after the end area reaches the second conveyer unit at the first lower rotation speed.

4. The printing apparatus according to claim 2, wherein the second conveyer path comprises a linear path formed on an upstream side in the second conveyer path with regard to the reverse direction and a curved path formed on a downstream side in the second conveyer path with regard to the reverse direction;

wherein the second roller unit is configured to convey the sheet in the linear path toward the curved path during the switchback process;

wherein the controller is configured to further execute a second ink amount determining process, in which whether a discharged ink amount being an amount of ink having been discharged in the first-face printing process at a midrange area on the first face of the sheet is smaller than a second threshold amount is determined, the midrange area being a downstream area from the end area with regard to the reverse direction;

wherein, based on a determination in the second ink amount determining process that the discharged ink amount at the midrange area is not smaller than the second threshold amount, the controller in the switchback setting process sets a rotation speed of the second conveyer roller unit for the switchback process to be reduced to a second lower rotation speed lower than a second higher rotation speed by the time when the end area of the sheet being conveyed reaches the curve path, and based on a different determination in the second ink amount determining process that the discharged ink amount at the midrange area is smaller than the second threshold amount, the controller in the switchback setting process sets the rotation speed of the second conveyer roller unit at the second higher rotation speed when the discharged ink amount at the midrange area is determined to be smaller than the second threshold amount.

5. The printing apparatus according to claim 4, wherein, based on the determination in the second ink amount determining process that the discharged ink amount at the midrange area is not smaller than the second threshold amount, the controller in the switchback process sets the rotation speed of the second roller unit for conveying the sheet until the end area reaches the curved path at the second higher rotation speed and sets the rotation speed of the second roller unit for conveying the sheet after the end area reaches the curved path at the second lower rotation speed.

6. The printing apparatus according to claim 4, wherein, based on the determination in the first ink amount determining process that the discharged ink amount at the end area is smaller than the first threshold amount and further based on the different determination in the second ink amount determining process that the discharged ink amount at the midrange area is smaller than the second threshold amount, the controller in the switchback setting process sets the rotation speeds of the first roller unit and the second roller unit for conveying the sheet until the end area reaches the curved path to be maintained at the first higher rotation speed and the second higher rotation speed, respectively.

* * * * *